US009586792B2

(12) United States Patent
Shiraishi

(10) Patent No.: US 9,586,792 B2
(45) Date of Patent: Mar. 7, 2017

(54) EMERGENCY STOP DEVICE FOR ELEVATOR

(75) Inventor: Naohiro Shiraishi, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/419,119

(22) PCT Filed: Aug. 2, 2012

(86) PCT No.: PCT/JP2012/069713

§ 371 (c)(1),
(2), (4) Date: Feb. 19, 2015

(87) PCT Pub. No.: WO2014/020743

PCT Pub. Date: Feb. 6, 2014

(65) Prior Publication Data

US 2015/0217971 A1 Aug. 6, 2015

(51) Int. Cl.
*B66B 5/22* (2006.01)

(52) U.S. Cl.
CPC ..... *B66B 5/22* (2013.01)

(58) Field of Classification Search
CPC ..... B66B 5/22
(Continued)

(56) References Cited

U.S. PATENT DOCUMENTS 5,503,257 A 4/1996 Sugita et al.
6,371,261 B1 * 4/2002 Thompson ..... B66B 5/22 187/370
(Continued)

FOREIGN PATENT DOCUMENTS

EP 1 930 282 A1 6/2008
JP 62 222990 9/1987
(Continued)

OTHER PUBLICATIONS

Japanese Office Action issued Jan. 5, 2016 in Patent Application No. 2014-527912 (with English language translation).
(Continued)

*Primary Examiner* — Michael Riegelman

(74) *Attorney, Agent, or Firm* — Oblon, McClelland, Maier & Neustadt, L.L.P.

(57) ABSTRACT

An emergency stop device for an elevator, including: a supporting member; a receiving-side braking member provided to the supporting member; a pressing-side braking member for gripping a guide rail together with the receiving-side braking member by being displaced upward with respect to the supporting member while being guided by an inclined guide portion of the supporting member; and an adjusting elastic member for generating an elastic restoring force acting against the upward displacement of the pressing-side braking member. A magnitude of a gripping force, which is generated when the guide rail is gripped between the receiving-side braking member and the pressing-side braking member, increases as the pressing-side braking member is displaced upward with respect to the supporting member. A magnitude of the elastic restoring force of the adjusting elastic member increases as the pressing-side braking member is displaced upward with respect to the supporting member.

2 Claims, 9 Drawing Sheets

(58) Field of Classification Search
USPC ..... 187/376
See application file for complete search history.

(56) References Cited

U.S. PATENT DOCUMENTS

| | | | | |
|---|---|---|---|---|
| 6,802,402 | B2 * | 10/2004 | Bausch | B60T 13/04 188/161 |
| 9,321,611 | B2 * | 4/2016 | Wei | B66B 5/22 |
| 2002/0117357 | A1 | 8/2002 | Hugel | |
| 2002/0134624 | A1 * | 9/2002 | Sasaki | B66B 5/22 187/376 |
| 2003/0085078 | A1 * | 5/2003 | Simmonds | B66B 5/22 187/373 |
| 2007/0051563 | A1 * | 3/2007 | Oh | B66B 5/22 187/371 |
| 2007/0181378 | A1 * | 8/2007 | Kigawa | B66B 5/06 187/376 |
| 2008/0128218 | A1 * | 6/2008 | Gremaud | B66B 5/22 187/250 |
| 2011/0088983 | A1 * | 4/2011 | Sirigu | B66B 5/22 187/373 |
| 2012/0175194 | A1 * | 7/2012 | Nikawa | B66B 5/22 187/376 |

FOREIGN PATENT DOCUMENTS

| | | | |
|---|---|---|---|
| JP | 5 147856 | | 6/1993 |
| JP | 9-328268 | A | 12/1997 |
| JP | 2007-45587 | A | 2/2007 |
| JP | 2008 290832 | | 12/2008 |
| JP | 2008-303014 | A | 12/2008 |
| JP | 2009-46274 | A | 3/2009 |
| WO | 2006 064555 | | 6/2006 |

OTHER PUBLICATIONS

International Search Report Issued Jan. 22, 2013 in PCT/JP12/069713 Filed Aug. 2, 2012.

Extended European Search Report issued on Feb. 29, 2016 in Patent Application No. 12882341.6.

Office Action issued Aug. 8, 2016 in Korean Patent Application No. 10-2015-7004187 (with English language translation).

* cited by examiner

EMERGENCY STOP DEVICE FOR ELEVATOR

TECHNICAL FIELD

The present invention relates to an emergency stop device for an elevator, which is configured to apply a braking force to an elevating body (for example, a car, a counterweight, or the like) to bring the elevating body to an emergency stop.

BACKGROUND ART

Hitherto, the following emergency stop device for an elevator has been known. In order to bring an elevating body to an emergency stop, the emergency stop device applies a braking force to the elevating body by using a pair of braking elements to grip a guide rail for guiding the elevating body. When the pair of braking elements is guided by an inclined portion of a supporting member mounted to the elevating body to be displaced upward with respect to the supporting member, the pair of braking elements approaches the guide rail from both sides to grip the guide rail.

Hitherto, the following emergency stop device for an elevator has been proposed. In order to adjust the magnitude of the braking force to be applied to the elevating body, removable shims are each mounted between the braking element and an upper frame part for inhibiting the upward displacement of the braking element. By adjusting the height dimension of the shim through replacement of the shim, the upper limit position of the braking element with respect to the supporting member is adjusted (for example, see Patent Literature 1).

Further, hitherto, the following emergency stop device for an elevator has also been proposed. In order to adjust the magnitude of the braking force to be applied to the elevating body, adjusting bolts are each provided to the upper end portion of the braking element. By adjusting the protruding amount of the adjusting bolt from the upper end portion of the braking element, the upper limit position of the braking element with respect to the supporting member is adjusted (for example, see Patent Literature 2).

CITATION LIST

Patent Literature

[PTL 1] JP 2008-290832 A
[PTL 2] JP 62-222990 A

SUMMARY OF INVENTION

Technical Problem

However, in such a related-art emergency stop device for an elevator described above, the magnitude of the braking force that the emergency stop device applies to the elevating body cannot be adjusted while the elevator is in operation, and thus the magnitude of the braking force that the emergency stop device applies to the elevating body while the elevator is in operation is constant. In contrast, in an actual elevator, for example, depending on the variation of the number of passengers riding in the elevating body and whether or not a main rope for suspending the elevating body is broken, the magnitude of the load applied to the emergency stop device significantly varies while the elevator is in operation.

In the related-art elevator, the magnitude of the braking force to be applied to the elevating body when the emergency stop device is operated is constant regardless of the variation of the magnitude of the load applied to the emergency stop device. Therefore, the elevating body decelerating performance significantly varies depending on the state of the elevator. Depending on the state of the elevator, the elevating body sharply decelerates to apply a large impact to the elevating body.

The present invention has been made to solve the problem described above, and has an object to obtain an emergency stop device for an elevator, which is capable of setting the magnitude of the braking force to be applied to the elevating body to a more appropriate magnitude regardless of the state of the elevator.

Solution to Problem

According to one embodiment of the present invention, there is provided an emergency stop device for an elevator, including: a supporting member including an inclined guide portion that is inclined with respect to a guide rail for guiding an elevating body, the supporting member being provided to the elevating body; a receiving-side braking member provided to the supporting member; a pressing-side braking member for gripping the guide rail together with the receiving-side braking member by being displaced upward with respect to the supporting member while being guided by the inclined guide portion; and an adjusting elastic member for generating an elastic restoring force acting against the upward displacement of the pressing-side braking member with respect to the supporting member, in which a magnitude of a gripping force, which is generated when the guide rail is gripped between the receiving-side braking member and the pressing-side braking member, increases as the pressing-side braking member is displaced upward with respect to the supporting member, and in which a magnitude of the elastic restoring force of the adjusting elastic member increases as the pressing-side braking member is displaced upward with respect to the supporting member.

Advantageous Effects of Invention

According to the emergency stop device for an elevator of one embodiment of the present invention, when the emergency stop device carries out the braking operation, the amount of upward displacement of the pressing-side braking member may be adjusted in accordance with the magnitude of the load applied to the emergency stop device. With this, the magnitude of the braking force to be applied to the elevating body can be set to a more appropriate magnitude regardless of the state of the elevator.

DESCRIPTION OF EMBODIMENTS

Now, exemplary embodiments of the present invention are described with reference to the drawings.

First Embodiment

Figure 1:
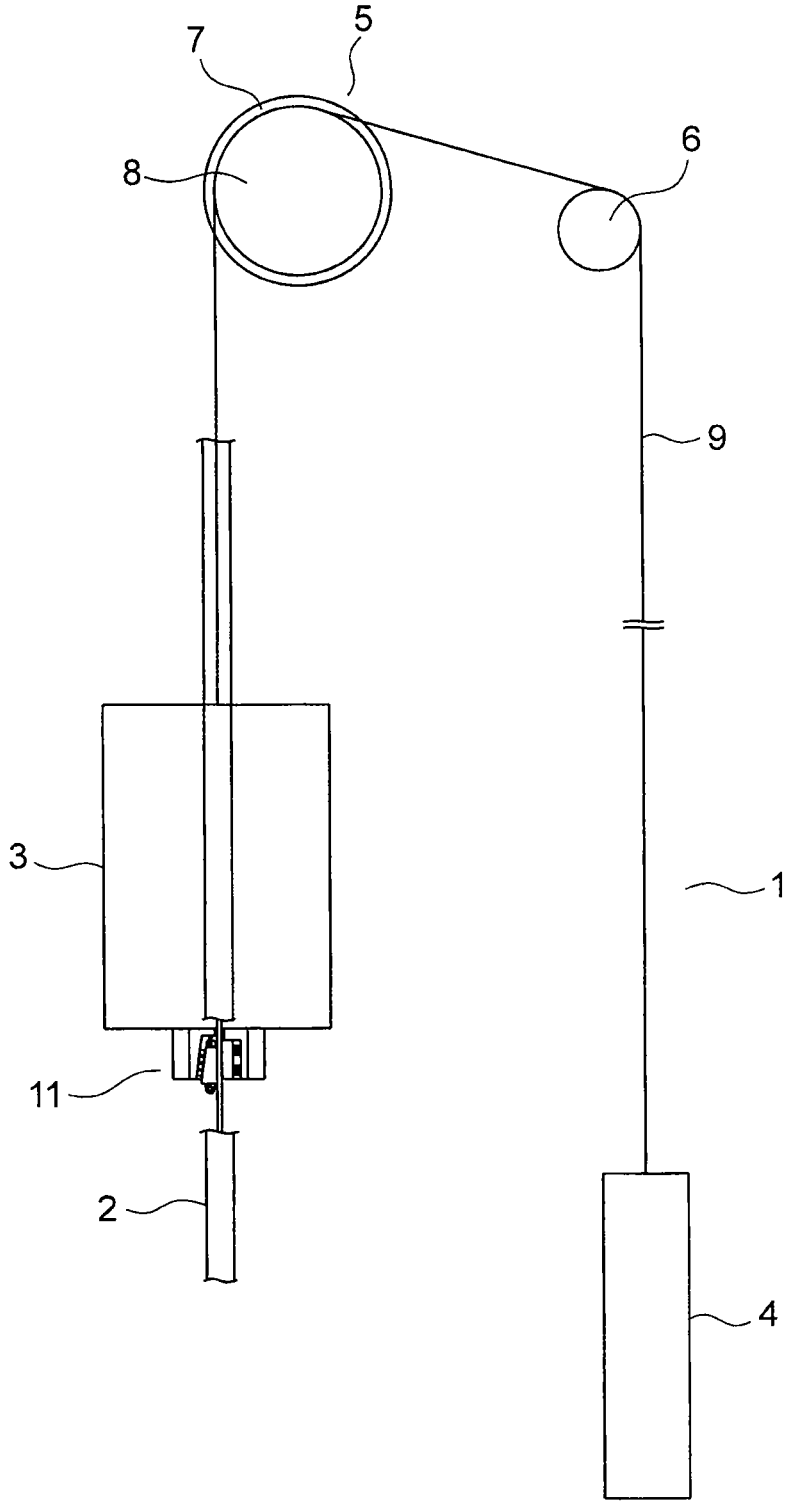
FIG. 1 is a configuration diagram illustrating an elevator according to a first embodiment of the present invention.

FIG. 1 is a configuration diagram illustrating an elevator according to a first embodiment of the present invention. In FIG. 1, inside a hoistway 1, a pair of car guide rails 2 and a pair of counterweight guide rails (not shown) are installed. A car (elevating body) 3 is provided between the pair of car guide rails 2 in a manner that the car 3 can be raised and lowered. A counterweight 4 is provided between the pair of counterweight guide rails in a manner that the counterweight 4 can be raised and lowered.

In the upper part of the hoistway 1, a hoisting machine 5 and a deflector sheave 6 are provided. The hoisting machine 5 is a driving device for generating a driving force for raising and lowering the car 3 and the counterweight 4. Further, the hoisting machine 5 includes a hoisting machine main body (driving device main body) 7 including a motor, and a driving sheave 8 that is provided to the hoisting machine main body 7 to be rotated by the hoisting machine main body 7. The deflector sheave 6 is arranged apart from the driving sheave 8 in the horizontal direction.

A plurality of suspending members 9 for suspending the car 3 and the counterweight 4 are wound around the driving sheave 8 and the deflector sheave 6. As the suspending members 9, for example, ropes and belts are used. The car 3 is raised and lowered inside the hoistway 1 while being guided by the respective car guide rails in response to the rotation of the driving sheave 8. The counterweight 4 is raised and lowered inside the hoistway 1 in a direction opposite to that of the car 3 while being guided by the respective counterweight guide rails in response to the rotation of the driving sheave 8.

At the lower portion of the car 3, a pair of emergency stop devices 11 for applying a braking force to the car 3 when the speed of the car 3 becomes excessive (abnormal) is provided so as to be individually opposed to the pair of car guide rails 2. The pair of emergency stop devices 11 is configured to operate in association with each other. An operation lever (not shown) is provided to any one of the pair of emergency stop devices 11.

The operation lever is connected to a speed governor rope (not shown). The speed governor rope is wound around a speed governor sheave (not shown) of a speed governor installed in the upper part of the hoistway 1. When the car 3 is raised and lowered, the speed governor rope is moved together with the car 3, and the speed governor sheave is rotated in accordance with the movement of the car 3. When the rotational speed of the speed governor sheave becomes excessive (abnormal), the speed governor grips the speed governor rope. The operation lever is operated when the speed governor grips the speed governor rope to displace the car 3 with respect to the speed governor rope.

When the operation lever is operated, each of the emergency stop devices 11 carries out a braking operation of individually gripping the corresponding car guide rail 2. When the emergency stop device 11 carries out the braking operation, a braking force is applied to the car 3, and thus the car 3 decelerates to be brought to an emergency stop. A force F of the emergency stop device 11 to grip the car guide rail 2 (gripping force of the emergency stop device 11) is adjusted so that the car 3 decelerates at a constant deceleration equal to or less than 1 G (G: acceleration of gravity) (for example, 0.6 G).

Figure 2:
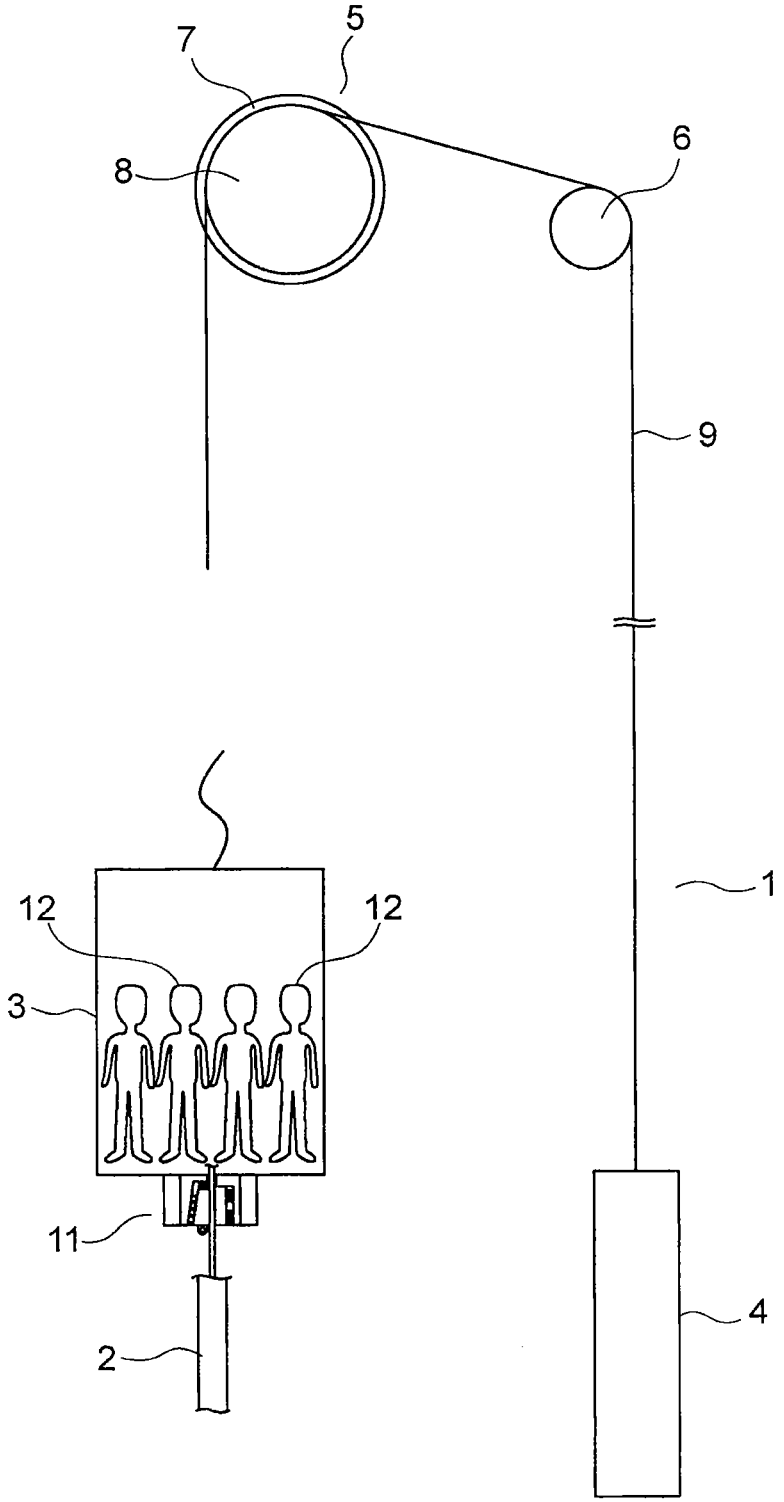
FIG. 2 is a configuration diagram illustrating the elevator when a suspending member is broken under a state in which passengers are riding in a car of FIG. 1.

FIG. 2 is a configuration diagram illustrating the elevator when the suspending member 9 is broken under a state in which passengers 12 are riding in the car 3 of FIG. 1. FIG. 2 illustrates a state in which the car 3 carries a full capacity of passengers 12. As illustrated in FIG. 2, when the suspending member 9 is broken, the car 3 accelerates due to the gravity, and the lowering speed of the car 3 increases. When the lowering speed (falling speed) of the car 3 becomes excessive, the operation lever of the emergency stop device 11 is operated because the speed governor grips the speed governor rope. With this, the emergency stop device 11 carries out the braking operation. At this time, the emergency stop device 11 is applied with not only the load of the passengers 12 inside the car 3, but also the entire load of the car 3 itself. Therefore, the state illustrated in FIG. 2 in which the suspending member 9 is broken and the car 3 carries a full capacity of passengers 12 corresponds to a high load applied state in which the maximum load is applied to the emergency stop device 11 during the braking operation.

In contrast, the state illustrated in FIG. 1 corresponds to a state in which the suspending member 9 is not broken and no passenger 12 is riding in the car 3. When the emergency stop device 11 carries out the braking operation under the state illustrated in FIG. 1, there is no load of the passengers, and a part of the load of the car 3 is reduced by the load of the counterweight 4. Therefore, a load W1 applied to the emergency stop device 11 at this time is significantly smaller than a load W2 applied to the emergency stop device 11 when the emergency stop device 11 carries out the braking operation under the state illustrated in FIG. 2 ($W1<W2$). Therefore, the state illustrated in FIG. 1 in which the suspending member 9 is not broken and no passenger 12 is riding in the car 3 corresponds to a low load applied state in which the minimum load is applied to the emergency stop device 11 during the braking operation.

That is, a load W applied to the emergency stop device 11 when the emergency stop device 11 carries out the braking operation is larger under a state in which the suspending member 9 is broken than under a state in which the suspending member 9 is not broken, and the load W increases as the load of the passengers 12 riding in the car 3 increases.

As described above, the load W applied to the emergency stop device 11 when the emergency stop device 11 carries out the braking operation differs depending on the magnitude of the load inside the car 3 and whether or not the suspending member 9 is broken.

Figure 3:
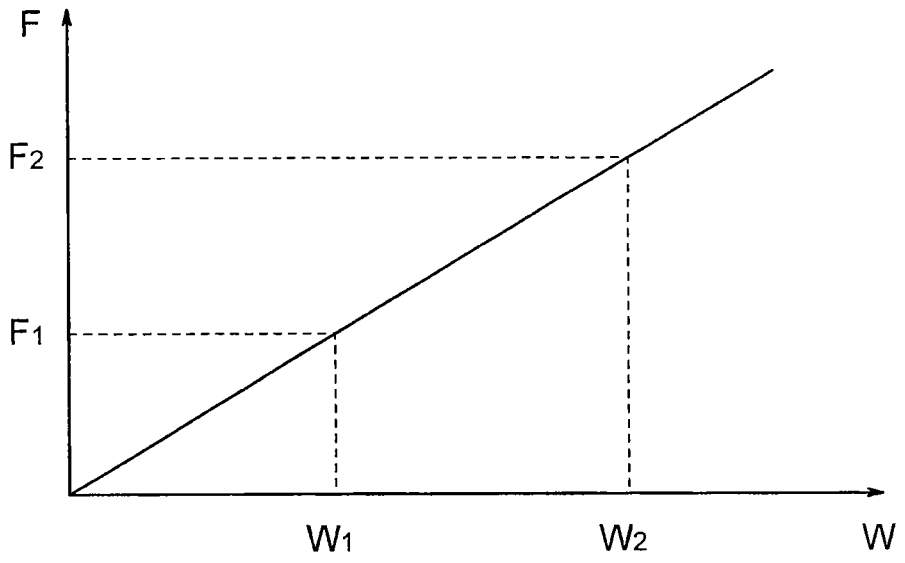
FIG. 3 is a graph showing the relationship between a gripping force F of an emergency stop device and a load W applied to the emergency stop device when the car decelerates at a constant deceleration in response to a braking operation of the emergency stop device in FIG. 1.

FIG. 3 is a graph showing the relationship between the gripping force F of the emergency stop device 11 and the load W applied to the emergency stop device 11 when the car 3 decelerates at a constant deceleration (for example, 0.6 G) in response to the braking operation of the emergency stop device 11 in FIG. 1. In the emergency stop device 11, as shown in FIG. 3, the gripping force F of the emergency stop device 11 changes depending on the change of the load W applied to the emergency stop device 11. Thus, the deceleration of the car 3 when the car 3 decelerates in response to the braking operation of the emergency stop device 11 is held constant. Therefore, in the emergency stop device 11, the magnitude of a gripping force (gripping force for the applied load W2) F2 during the braking operation in the high load applied state is larger than the magnitude of a gripping force (gripping force for the applied load W1) F1 during the braking operation in the low load applied state.

Figure 4:
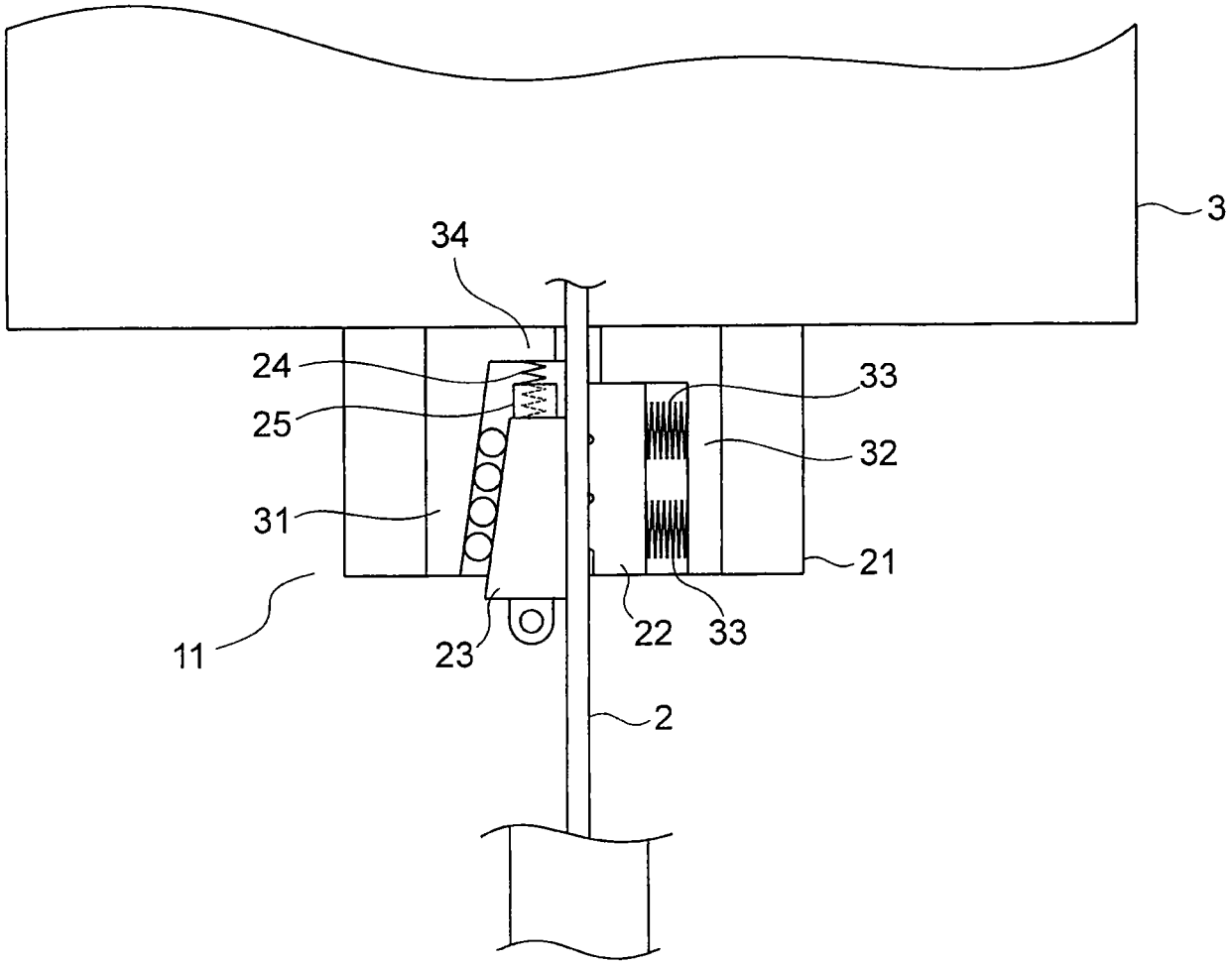
FIG. 4 is an enlarged diagram illustrating a state in which the emergency stop device in FIG. 1 carries out the braking operation.
Figure 5:
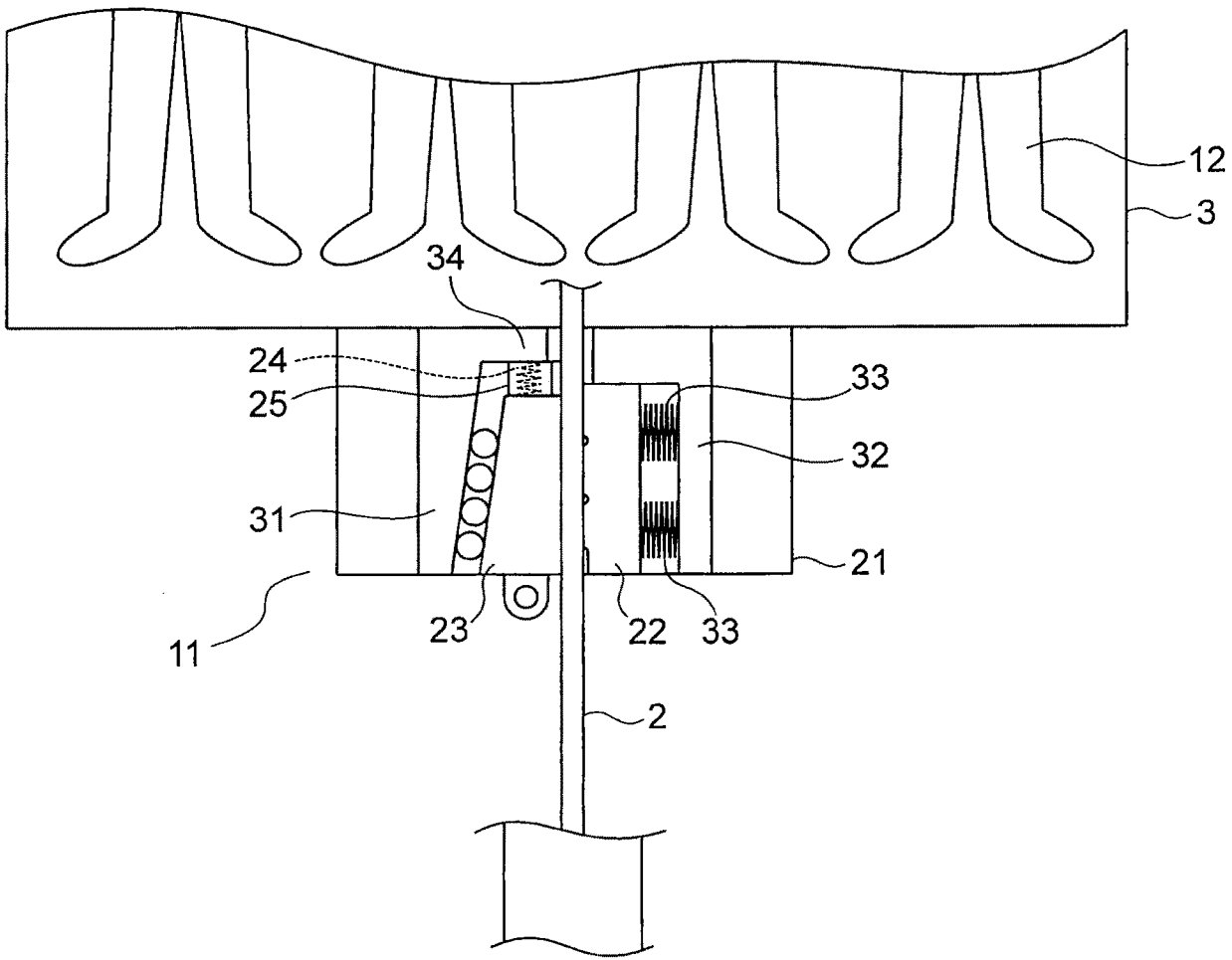
FIG. 5 is an enlarged diagram illustrating a state in which the emergency stop device in FIG. 2 carries out the braking operation.

FIG. 4 is an enlarged diagram illustrating a state in which the emergency stop device 11 in FIG. 1 carries out the braking operation. Further, FIG. 5 is an enlarged diagram illustrating a state in which the emergency stop device 11 in FIG. 2 carries out the braking operation. In FIGS. 4 and 5, the emergency stop device 11 includes an emergency stop frame (supporting member) 21 fixed to the lower end portion of the car 3, a receiving-side braking member 22 provided to the emergency stop frame 21, a pressing-side braking member 23 that interlocks with the operation lever and is capable of gripping the car guide rail 2 together with the receiving-side braking member 22, an adjusting elastic member 24 provided on the upper end portion of the pressing-side braking member 23, and a stopper 25 provided on the upper end portion of the pressing-side braking member 23 so as to avoid the adjusting elastic member 24.

The emergency stop frame 21 includes an inclined guide portion 31 and a support receiving portion 32 that are provided apart from each other in the horizontal direction. The car guide rail 2 passes through a space between the inclined guide portion 31 and the support receiving portion 32. The inclined guide portion 31 is inclined with respect to the support receiving portion 32 so that the interval between the inclined guide portion 31 and the support receiving portion 32 is continuously narrowed toward the upward side. With this, the inclined guide portion 31 is inclined also with respect to the car guide rail 2 so that the interval between the inclined guide portion 31 and the car guide rail 2 is continuously narrowed toward the upward side.

The receiving-side braking member 22 is arranged in a space between the car guide rail 2 and the support receiving portion 32. A plurality of gripping elastic members 33 are provided between the receiving-side braking member 22 and the support receiving portion 32. The gripping elastic members 33 generate an elastic restoring force in response to the displacement of the receiving-side braking member 22 in a direction to approach the support receiving portion 32. The magnitude of the elastic restoring force of the gripping elastic members 33 increases as the receiving-side braking member 22 approaches the support receiving portion 32.

The pressing-side braking member 23 is arranged in a space between the car guide rail 2 and the inclined guide portion 31. Under a normal state in which the emergency stop device 11 does not carry out the braking operation, the pressing-side braking member 23 is placed at a normal position apart from the car guide rail 2. When the speed of the car 3 becomes excessive and the operation lever is operated, the pressing-side braking member 23 is displaced upward with respect to the emergency stop frame 21 while being guided by the inclined guide portion 31 from the normal position.

When the pressing-side braking member 23 is displaced upward with respect to the emergency stop frame 21 while being guided by the inclined guide portion 31 from the normal position, the pressing-side braking member 23 is displaced in the direction to approach the support receiving portion 32, to thereby grip the car guide rail 2 together with the receiving-side braking member 22. The emergency stop device 11 is configured to grip the car guide rail 2 between the pressing-side braking member 23 and the receiving-side braking member 22 to generate a braking force on the car 3.

When the pressing-side braking member 23 is further displaced upward with respect to the emergency stop frame 21 after the car guide rail 2 is gripped between the pressing-side braking member 23 and the receiving-side braking member 22, the interval between the inclined guide portion 31 and the car guide rail 2 is increased through the pressing by the pressing-side braking member 23. With this, the receiving-side braking member 22 is displaced in the direction to approach the support receiving portion 32, and the elastic restoring forces of the gripping elastic members 33 increase. The magnitude of the gripping force F of the emergency stop device 11 increases as the elastic restoring forces of the gripping elastic members 33 increase. That is, the magnitude of the gripping force F of the emergency stop device 11 (gripping force generated when the car guide rail 2 is gripped between the pressing-side braking member 23 and the receiving-side braking member 22) increases as the pressing-side braking member 23 is displaced upward with respect to the emergency stop frame 21.

A regulating portion 34 positioned above the pressing-side braking member 23 is fixed to the emergency stop frame 21. The adjusting elastic member 24 is arranged between the pressing-side braking member 23 and the regulating portion 34. As the adjusting elastic member 24 and the gripping elastic member 33, an elastic member made of a material having elasticity by its own (such as rubber) or an elastic member made of a material processed to achieve elasticity (such as a coil spring, a disc spring, and a ring spring) is used.

When the pressing-side braking member 23 is placed at the normal position, the adjusting elastic member 24 is separated from the regulating portion 34 on the lower side. When the pressing-side braking member 23 is displaced upward with respect to the emergency stop frame 21 from the normal position, the adjusting elastic member 24 hits against the regulating portion 34, and is then compressed between the pressing-side braking member 23 and the regulating portion 34. With this, the adjusting elastic member 24 generates an elastic restoring force acting against the upward displacement of the pressing-side braking member 23 with respect to the emergency stop frame 21. The magnitude of the elastic restoring force of the adjusting elastic member 24 changes depending on the compressed amount of the adjusting elastic member 24. That is, the magnitude of the elastic restoring force of the adjusting elastic member 24 increases as the pressing-side braking member 23 is displaced upward with respect to the emergency stop frame 21 (that is, as the pressing-side braking member 23 is displaced in the direction to approach the regulating portion 34).

When the emergency stop device 11 carries out the braking operation, the pressing-side braking member 23 is displaced upward with respect to the emergency stop frame 21 against the elastic restoring force of the adjusting elastic member 24. The force to displace the pressing-side braking member 23 upward with respect to the emergency stop frame 21 changes depending on the magnitude of the load W applied to the emergency stop device 11 when the emergency stop device 11 carries out the braking operation. Therefore, the amount of upward displacement of the pressing-side braking member 23 with respect to the emergency stop frame 21 increases as the load W applied to the emergency stop device 11 increases. With this, the magnitude of the gripping force F of the emergency stop device 11 also increases as the load W applied to the emergency stop device 11 increases.

The stopper 25 inhibits the upward displacement of the pressing-side braking member 23 by being sandwiched between the regulating portion 34 and the pressing-side braking member 23 when the pressing-side braking member 23 reaches a predetermined upper limit position with respect to the emergency stop frame 21. With this, the pressing-side braking member 23 is prevented from being displaced further upward with respect to the predetermined upper limit position, and thus the gripping force F of the emergency stop device 11 is prevented from increasing too much. In this embodiment, the stopper 25 is a non-elastic cylindrical member that surrounds the adjusting elastic member 24. The height dimension of the stopper 25 is smaller than the height dimension of the adjusting elastic member 24. With this, the stopper 25 hits against the regulating portion 34 to be sandwiched between the pressing-side braking member 23 and the regulating portion 34 under a state in which the adjusting elastic member 24 is compressed between the pressing-side braking member 23 and the regulating portion 34. Therefore, in this embodiment, the regulating portion 34 has both a function of an elastic member receiving portion for receiving the adjusting elastic member 24 and a function of a stopper receiving portion for receiving the stopper 25.

When the emergency stop device 11 carries out the braking operation in the low load applied state illustrated in FIGS. 1 and 4 (that is, when the load W applied to the emergency stop device 11 is W1 in FIG. 3), while the stopper 25 is separated from the regulating portion 34, the elastic restoring force of the adjusting elastic member 24 suppresses the upward displacement of the pressing-side braking member 23 with respect to the emergency stop frame 21. With this, the amount of upward displacement of the pressing-side braking member 23 with respect to the emergency stop frame 21 is reduced, and the magnitude of the gripping force F of the emergency stop device 11 is reduced in accordance with the magnitude of the load W1 applied to the emergency stop device 11.

When the emergency stop device 11 carries out the braking operation in the high load applied state illustrated in FIGS. 2 and 5 (that is, the load W applied to the emergency stop device 11 is W2 in FIG. 3), the elastic restoring force of the adjusting elastic member 24 cannot sufficiently suppress the upward displacement of the pressing-side braking member 23. Thus, the stopper 25 reaches the regulating portion 34 to reach the predetermined upper limit position of the pressing-side braking member 23. With this, the amount of upward displacement of the pressing-side braking member 23 with respect to the emergency stop frame 21 becomes maximum, and the magnitude of the gripping force F of the emergency stop device 11 takes a maximum value in a range set for the gripping force of the emergency stop device 11.

Next, the operation is described. When the car 3 is moved, the speed governor rope is moved together with the car 3, and the speed governor sheave is rotated in accordance with the movement of the car 3. When the lowering speed of the car 3 becomes excessive, the speed governor is operated to grip the speed governor rope by the speed governor. With this, the movement of the speed governor rope is stopped, and thus the car 3 is displaced downward with respect to the speed governor rope.

When the car 3 is displaced with respect to the speed governor rope, the operation lever is operated. With this, the pressing-side braking member 23 is displaced upward together with the adjusting elastic member 24 and the stopper 25 toward the regulating portion 34 while being guided by the inclined guide portion 31. With this, the car guide rail 2 is gripped between the pressing-side braking member 23 and the receiving-side braking member 22, and the adjusting elastic member 24 is sandwiched between the regulating portion 34 and the pressing-side braking member 23.

After that, when the pressing-side braking member 23 is further displaced upward with respect to the emergency stop frame while compressing the adjusting elastic member 24, the receiving-side braking member 22 approaches the support receiving portion 32 while being pressed by the car guide rail 2, and thus the gripping elastic members 33 are compressed between the receiving-side braking member 22 and the support receiving portion 32. With this, the elastic restoring force of the gripping elastic members 33 is generated, and the gripping force F of the emergency stop device 11 is generated. The car 3 is applied with a braking force in accordance with the gripping force F of the emergency stop device 11.

When the pressing-side braking member 23 is displaced upward with respect to the emergency stop frame 21 while compressing the adjusting elastic member 24, the magnitude of the elastic restoring force of the adjusting elastic member 24 increases as the pressing-side braking member 23 is displaced upward. Further, the pressing-side braking member 23 is displaced upward by a force with a magnitude corresponding to the load W applied to the emergency stop device 11. Therefore, the position at which the upward displacement of the pressing-side braking member 23 stops is placed upward as the magnitude of the load W applied to the emergency stop device 11 increases. That is, the position at which the upward displacement of the pressing-side braking member 23 stops is adjusted to a position corresponding to the magnitude of the load W applied to the emergency stop device 11 by the elastic restoring force of the adjusting elastic member 24. With this, the magnitude of the gripping force F of the emergency stop device 11 is adjusted in accordance with the magnitude of the load W applied to the emergency stop device 11.

When the elevator is in the low load applied state illustrated in FIGS. 1 and 4, if the emergency stop device 11 carries out the braking operation, while the stopper 25 is separated from the regulating portion 34, the upward displacement of the pressing-side braking member 23 stops due to the elastic restoring force of the adjusting elastic member 24. With this, the pressing-side braking member 23 is held at a position lower than the predetermined upper limit position, and at this time, the emergency stop device 11 generates the minimum gripping force F1.

When the elevator is in the high load applied state illustrated in FIGS. 2 and 5, if the emergency stop device 11 carries out the braking operation, the upward displacement of the pressing-side braking member 23 cannot stop with the elastic restoring force of the adjusting elastic member 24. Thus, the stopper 25 hits against the regulating portion 34 to inhibit the upward displacement of the pressing-side braking member 23. With this, the pressing-side braking member 23 reaches the predetermined upper limit position, and at this time, the emergency stop device 11 generates the maximum gripping force F2.

In such an emergency stop device 11 for an elevator, the magnitude of the gripping force F generated when the car guide rail 2 is gripped between the pressing-side braking member 23 and the receiving-side braking member 22 increases as the pressing-side braking member 23 is displaced upward with respect to the emergency stop frame 21, and the magnitude of the elastic restoring force of the adjusting elastic member 24 acting against the upward displacement of the pressing-side braking member 23 increases as the pressing-side braking member 23 is displaced upward with respect to the emergency stop frame 21. Therefore, when the emergency stop device 11 carries out the braking operation, the amount of upward displacement of the pressing-side braking member 23 can be adjusted in accordance with the magnitude of the load W applied to the emergency stop device 11. With this, even when the magnitude of the load W applied to the emergency stop device 11 varies due to the variation of the load of the passengers 12 riding in the car 3 or breakage of the suspending member 9 suspending the car 3, the magnitude of the gripping force F of the emergency stop device 11 with respect to the car guide rail 2 can be adjusted in accordance with the magnitude of the load W applied to the emergency stop device 11 while the elevator is in operation. Therefore, regardless of the state of the elevator, the magnitude of the braking force to be applied to the car 3 can be more appropriately set, and the car 3 is prevented from being applied with a large impact when the emergency stop device 11 carries out the braking operation.

Further, when the pressing-side braking member 23 reaches the predetermined upper limit position with respect to the emergency stop frame 21, the pressing-side braking member 23 is inhibited by the stopper 25. Therefore, the gripping force F of the emergency stop device 11 with respect to the car guide rail 2 is prevented from increasing too much, and the car 3 is more reliably prevented from being applied with a large impact when the emergency stop device 11 carries out the braking operation.

Further, the emergency stop frame 21 is provided with the regulating portion 34 positioned above the pressing-side braking member 23, and the adjusting elastic member 24 generates the elastic restoring force by being compressed between the pressing-side braking member 23 and the regulating portion 34. Therefore, the adjusting elastic member 24 can generate an elastic restoring force with a magnitude corresponding to the magnitude of the load W applied to the emergency stop device 11 with a simple configuration.

Note that, in the above-mentioned embodiment, the adjusting elastic member 24 is provided to the pressing-side braking member 23, but the adjusting elastic member 24 may be provided to the regulating portion 34. Also in this case, the adjusting elastic member 24 can be compressed between the pressing-side braking member 23 and the regulating portion 34, and the adjusting elastic member can generate an elastic restoring force with a magnitude corresponding to the magnitude of the load W applied to the emergency stop device 11.

Further, in the above-mentioned embodiment, the stopper 25 is provided to the pressing-side braking member 23, but the stopper 25 may be provided to the regulating portion 34. Also in this case, the stopper 25 can be sandwiched between the pressing-side braking member 23 and the regulating portion 34 to inhibit the upward displacement of the pressing-side braking member 23.

Further, in the above-mentioned embodiment, the regulating portion 34 is provided to the emergency stop frame 21, but the bottom portion of the car 3 may serve as the regulating portion 34. Also in this case, the adjusting elastic member 24 can be compressed between the pressing-side braking member 23 and the regulating portion 34, and the regulating portion 34 can receive the stopper 25 to inhibit the upward displacement of the pressing-side braking member 23.

Further, in the above-mentioned embodiment, the stopper 25 is a cylindrical member, but as long as the stopper 25 is arranged so as to avoid the adjusting elastic member 24, the stopper 25 may be formed into any shape.

Further, in the above-mentioned embodiment, the stopper 25 is provided to the pressing-side braking member 23, but the stopper 25 may be omitted if the force to displace the pressing-side braking member 23 upward can be received by the adjusting elastic member 24 when the emergency stop device 11 carries out the braking operation in the high load applied state illustrated in FIGS. 2 and 5.

Second Embodiment

Figure 6:
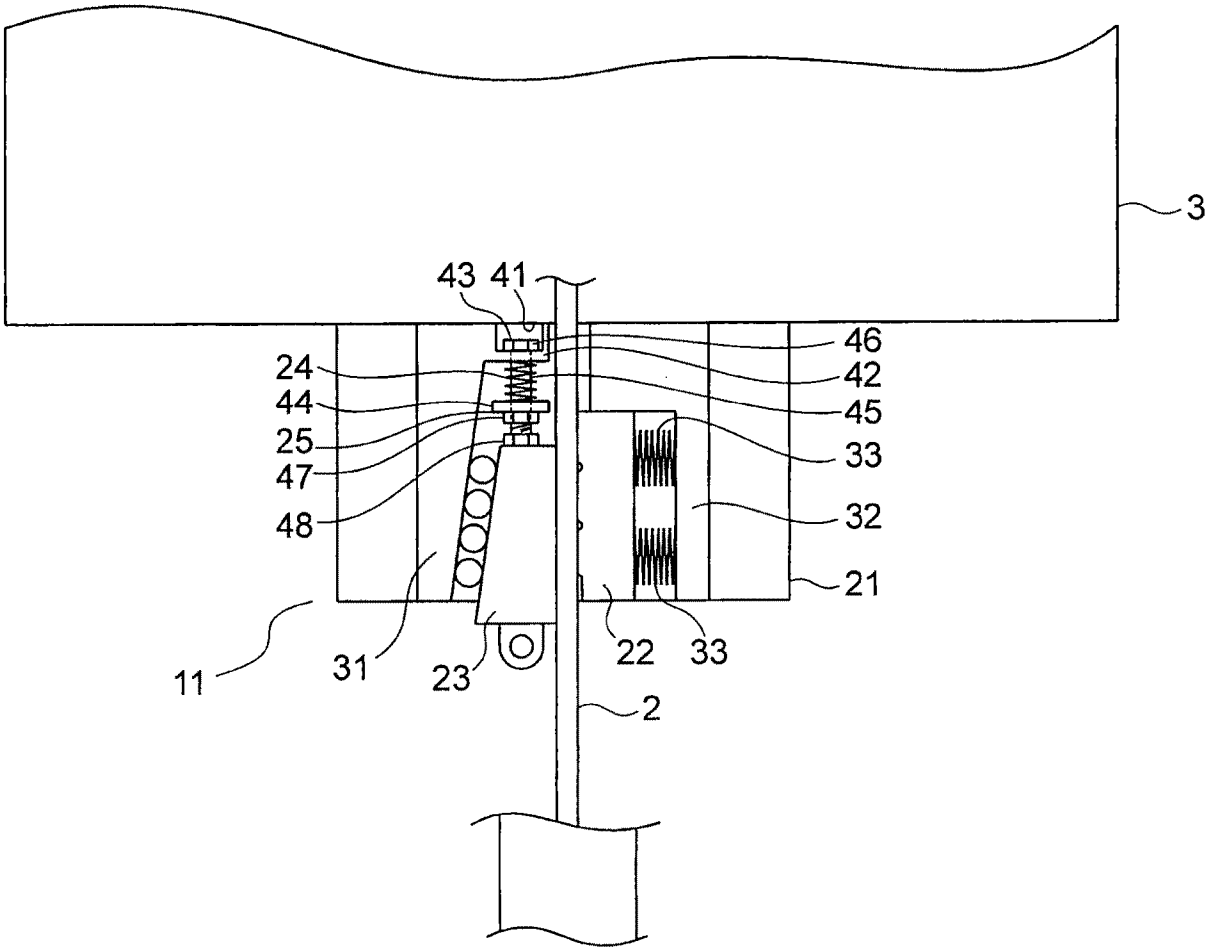
FIG. 6 is a configuration diagram illustrating a state in which an emergency stop device for an elevator according to a second embodiment of the present invention carries out a braking operation when the elevator is in a low load applied state.
Figure 7:
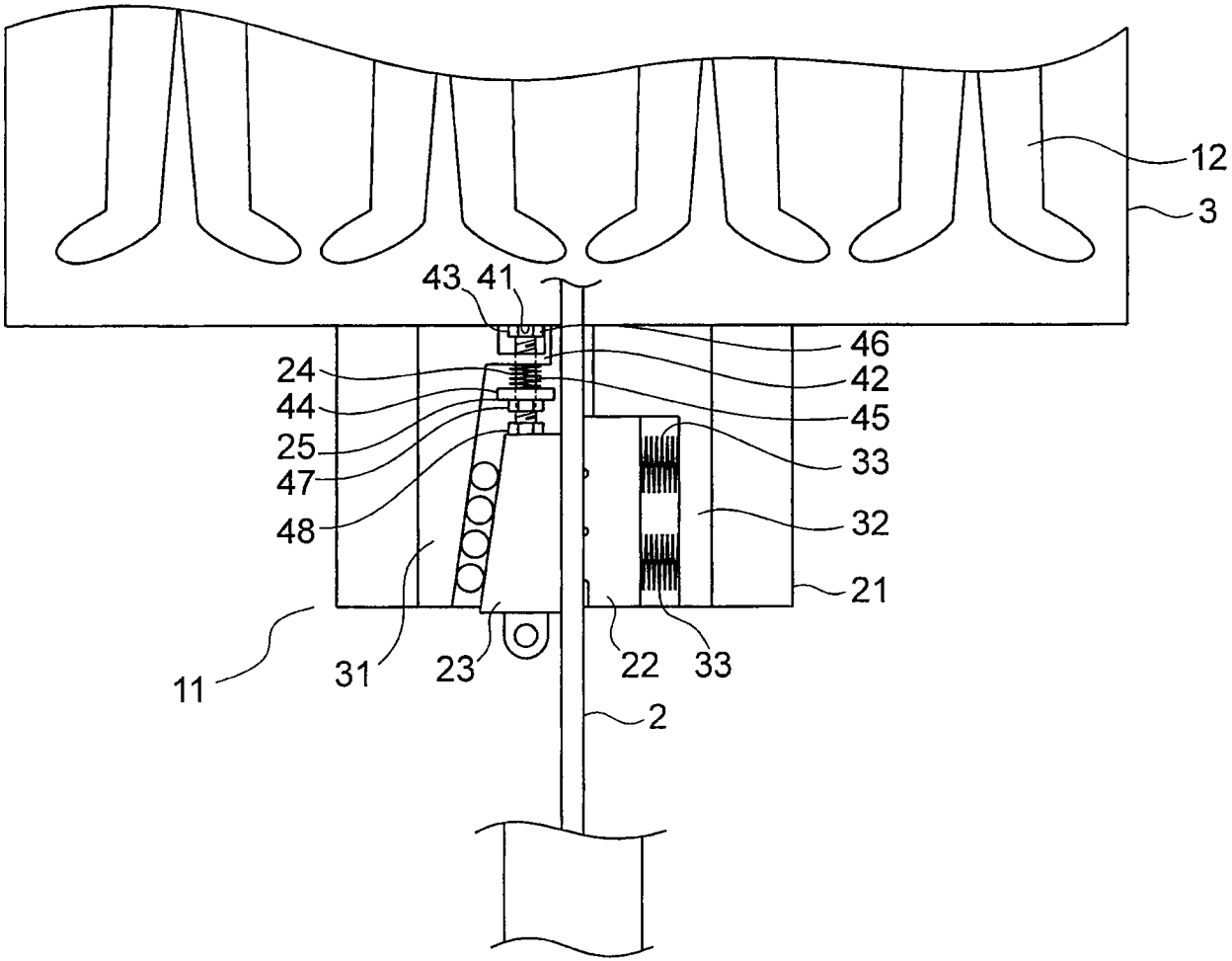
FIG. 7 is a configuration diagram illustrating a state in which the emergency stop device for an elevator in FIG. 6 carries out the braking operation when the elevator is in a high load applied state.

FIG. 6 is a configuration diagram illustrating a state in which an emergency stop device for an elevator according to a second embodiment of the present invention carries out a braking operation when the elevator is in a low load applied state. Further, FIG. 7 is a configuration diagram illustrating a state in which the emergency stop device for an elevator in FIG. 6 carries out the braking operation when the elevator is in a high load applied state. Note that, the low load applied state refers to a state in which the suspending member 9 for suspending the car 3 is not broken and no passenger 12 is riding in the car 3, and the high load applied state refers to a state in which the suspending member 9 for suspending the car 3 is broken and the car 3 carries a full capacity of passengers 12.

The bottom portion of the car 3 serves as a stopper receiving portion 41 for receiving the upward displacement of the stopper 25. A spring receiving portion (elastic member receiving portion) 42 is fixed to the emergency stop frame 21. The spring receiving portion 42 is placed above the pressing-side braking member 23 and below the stopper receiving portion 41.

The adjusting elastic member 24 and the stopper 25 are held by the spring receiving portion 42. The stopper 25 includes a bolt 43 that can be vertically displaced with respect to the spring receiving portion 42, and a retaining plate 44 mounted to the lower end portion of the bolt 43. The bolt 43 includes a threaded shaft portion 45 that vertically passes through the spring receiving portion 42, and a head portion (engaged portion) 46 fixed to the upper end portion of the threaded shaft portion. The retaining plate 44 is fixed to the bolt 43 by being threadably mounted to the lower end portion of the threaded shaft portion 45.

The adjusting elastic member 24 is compressed between the spring receiving portion 42 and the retaining plate 44. The stopper 25 is biased downward with respect to the spring receiving portion 42 by the elastic restoring force of the adjusting elastic member 24. The downward displacement of the stopper 25 with respect to the spring receiving portion 42 is regulated by engaging the head portion 46 of the bolt 43 with the spring receiving portion 42.

The pressing-side braking member 23 is provided with an adjusting bolt 47 that protrudes upward from the upper end portion of the pressing-side braking member 23, and a retaining nut 48 that is threadably mounted to the adjusting bolt 47.

The protruding amount of the adjusting bolt 47 from the upper end portion of the pressing-side braking member 23 is adjusted by adjusting the screwed amount of the adjusting bolt 47 with respect to the pressing-side braking member 23. The position of the adjusting bolt 47 with respect to the pressing-side braking member 23 is fixed by fastening the retaining nut 48.

The adjusting bolt 47 is separated from the stopper 25 on the lower side when the pressing-side braking member 23 is placed at the normal position. When the pressing-side braking member 23 is displaced upward with respect to the emergency stop frame 21, the adjusting bolt 47 hits against the bottom surface of the retaining plate 44 of the stopper 25, to thereby press the stopper 25 upward while compressing the adjusting elastic member 24. That is, the adjusting elastic member 24 is compressed between the pressing-side braking member 23 and the spring receiving portion 42 when the adjusting bolt 47 is displaced upward together with the pressing-side braking member 23 to press the retaining plate 44 upward. Thus, the adjusting elastic member 24 generates an elastic restoring force acting against the upward displacement of the pressing-side braking member 23 with respect to the emergency stop frame 21.

The stopper receiving portion 41 receives the head portion 46 of the stopper 25 when the pressing-side braking member 23 reaches the predetermined upper limit position with respect to the emergency stop frame 21. The upward displacement of the pressing-side braking member 23 with respect to the emergency stop frame 21 is inhibited through reception of the stopper 25 by the stopper receiving portion 41. That is, the upward displacement of the pressing-side braking member 23 is inhibited by the stopper 25 when the stopper 25 reaches the predetermined upper limit position with respect to the emergency stop frame 21.

When the emergency stop device 11 carries out the braking operation in the low load applied state illustrated in FIG. 6, while the stopper 25 is separated from the stopper receiving portion 41, the elastic restoring force of the adjusting elastic member 24 suppresses the upward displacement of the pressing-side braking member 23 with respect to the emergency stop frame 21. With this, the amount of upward displacement of the pressing-side braking member 23 with respect to the emergency stop frame 21 is reduced, and the magnitude of the gripping force F of the emergency stop device 11 is reduced in accordance with the magnitude of the load W1 applied to the emergency stop device 11.

When the emergency stop device 11 carries out the braking operation in the high load applied state illustrated in FIG. 7, the elastic restoring force of the adjusting elastic member 24 cannot sufficiently suppress the upward displacement of the pressing-side braking member 23. Thus, the stopper 25 reaches the stopper receiving portion 41 to reach the predetermined upper limit position of the pressing-side braking member 23. With this, the amount of upward displacement of the pressing-side braking member 23 with respect to the emergency stop frame 21 becomes maximum, and the magnitude of the gripping force F of the emergency stop device 11 takes a maximum value in a range set for the gripping force of the emergency stop device 11. Other configurations and operations are similar to those of the first embodiment.

As described above, even when the spring receiving portion 42 fixed to the emergency stop frame 21 is configured to hold the adjusting elastic member 24 and the stopper 25, the magnitude of the elastic restoring force of the adjusting elastic member 24 can be changed in accordance with the amount of upward displacement of the pressing-side braking member 23. Therefore, the amount of upward displacement of the pressing-side braking member 23 with respect to the emergency stop frame 21 can be adjusted in accordance with the magnitude of the load W applied to the emergency stop device 11. Therefore, even when the magnitude of the load W applied to the emergency stop device 11 varies, the magnitude of the gripping force F of the emergency stop device 11 with respect to the car guide rail 2 can be adjusted in accordance with the magnitude of the load W applied to the emergency stop device 11 while the elevator is in operation. Further, even when the adjusting elastic member 24 or the stopper 25 cannot be mounted on the upper end portion of the pressing-side braking member 23, the adjusting elastic member 24 and the stopper 25 can be provided to the emergency stop device 11.

Note that, in the above-mentioned embodiment, the adjusting bolt 47 and the retaining nut 48 are provided to the upper end portion of the pressing-side braking member 23, but the adjusting bolt 47 and the retaining nut 48 may be omitted so that the pressing-side braking member 23 directly hits against the stopper 25.

Further, in the above-mentioned embodiment, the bottom portion of the car 3 serves as the stopper receiving portion 41, and the spring receiving portion 42 is provided to the emergency stop frame 21, but each of the stopper receiving portion 41 and the spring receiving portion 42 may be provided to the emergency stop frame 21, or each of the stopper receiving portion 41 and the spring receiving portion 42 may be provided to the car 3.

Third Embodiment

Figure 8:
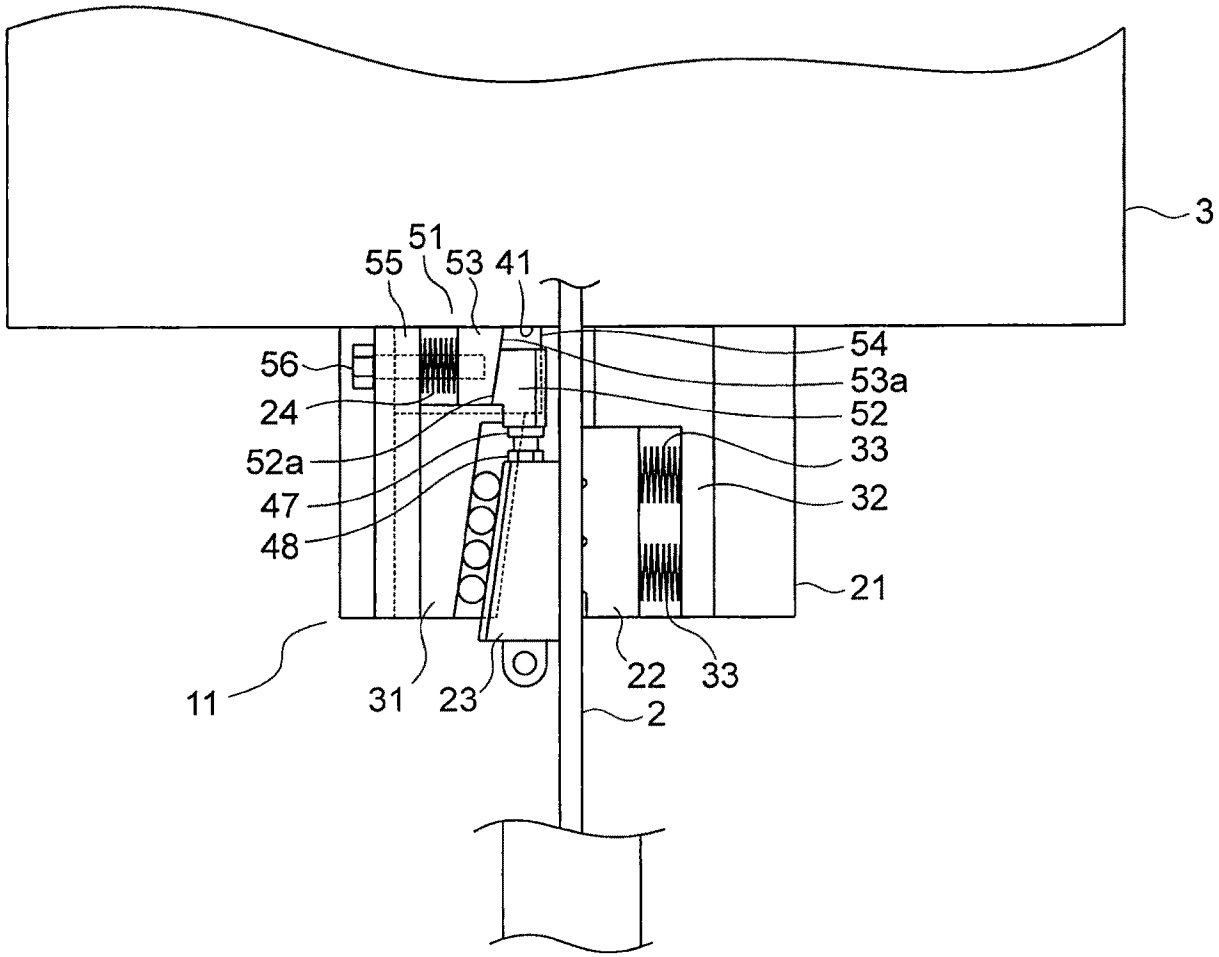
FIG. 8 is a configuration diagram illustrating a state in which an emergency stop device for an elevator according to a third embodiment of the present invention carries out a braking operation when the elevator is in a low load applied state.
Figure 9:
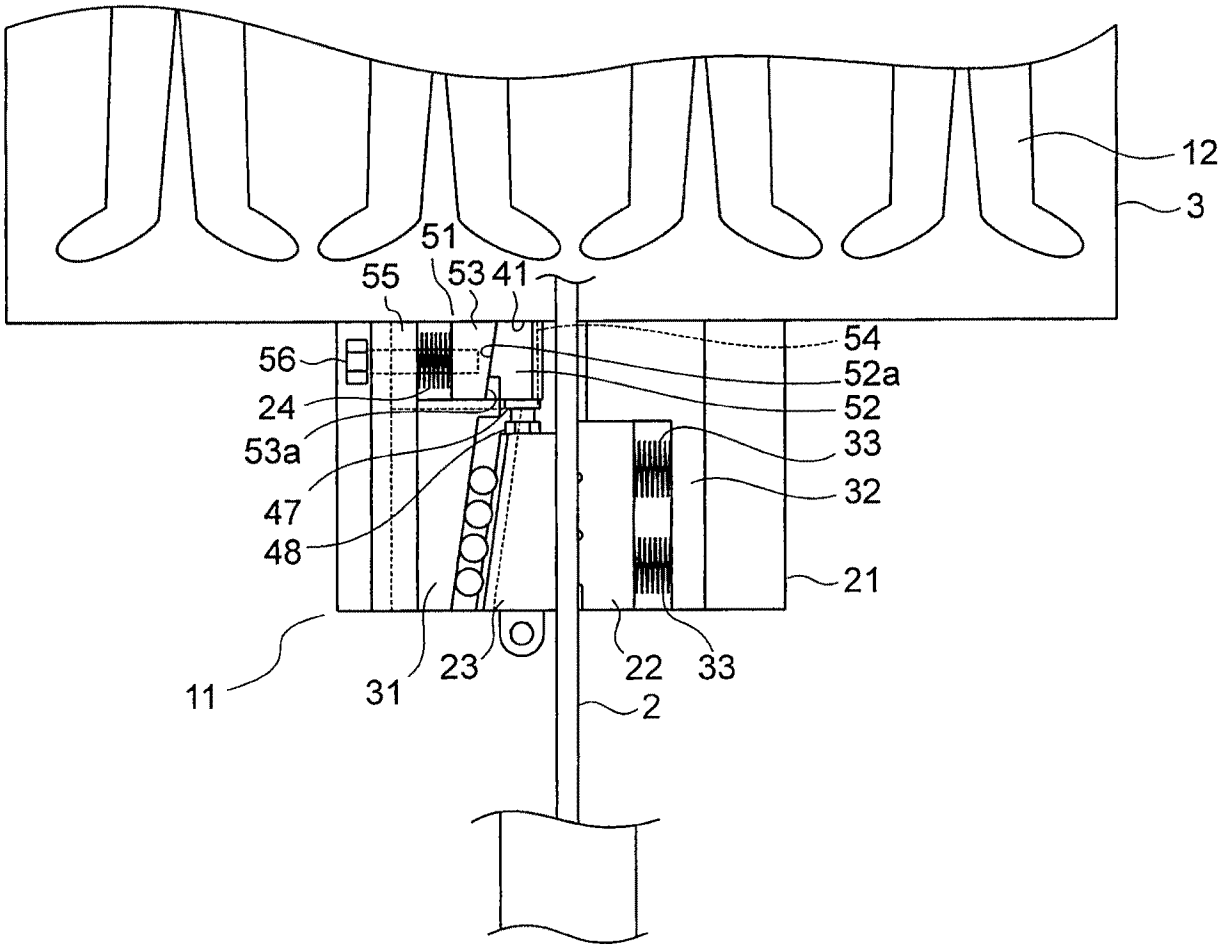
FIG. 9 is a configuration diagram illustrating a state in which the emergency stop device for an elevator in FIG. 8 carries out the braking operation when the elevator is in a high load applied state.

FIG. 8 is a configuration diagram illustrating a state in which an emergency stop device for an elevator according to a third embodiment of the present invention carries out a braking operation when the elevator is in a low load applied state. Further, FIG. 9 is a configuration diagram illustrating a state in which the emergency stop device for an elevator in FIG. 8 carries out the braking operation when the elevator is in a high load applied state. In FIGS. 8 and 9, the emergency stop frame 21 is provided with a pressing mechanism 51 for pressing the adjusting elastic member 24 in accordance with the upward displacement of the pressing-side braking member 23.

The pressing mechanism 51 includes an adjusting member 52 that can be displaced in the vertical direction (direction along the car guide rail 2) with respect to the emergency stop frame 21, whereby it comprises a stopper, and a pressing member 53 that is arranged at a position further separated from the car guide rail 2 than the adjusting member 52. The pressing member 53 is displaced in the horizontal direction (direction to change the distance with respect to the car guide rail 2) with respect to the emergency stop frame 21 in accordance with the vertical displacement of the adjusting member 52 with respect to the emergency stop frame 21.

An adjusting member guide portion 54 and an elastic member receiving portion 55 are fixed to the emergency stop frame 21. The adjusting member guide portion 54 guides the vertical displacement of the adjusting member 52. The elastic member receiving portion 55 is arranged at a position further separated from the car guide rail 2 than the pressing member 53.

The adjusting member 52 is arranged between the pressing-side braking member 23 and the stopper receiving portion 41 corresponding to the bottom portion of the car 3. Further, the upward displacement of the adjusting member 52 is inhibited through engagement with the stopper receiving portion 41 (that is, through reception of the adjusting member 52 by the stopper receiving portion 41), and the downward displacement of the adjusting member 52 is inhibited through engagement with the upper end portion of the inclined guide portion 31. Therefore, the adjusting member 52 is displaced with respect to the emergency stop frame 21 while being guided by the adjusting member guide portion 54 in a range between an adjusting member upper limit position for engagement with the stopper receiving portion 41 and an adjusting member lower limit position for engagement with the upper end portion of the inclined guide portion 31.

The adjusting bolt 47 provided at the upper end portion of the pressing-side braking member 23 is separated from the adjusting member 52 on the lower side when the pressing-side braking member 23 is placed at the normal position. When the pressing-side braking member 23 is displaced upward with respect to the emergency stop frame 21, the adjusting bolt 47 hits against the bottom surface of the adjusting member 52 to press the adjusting member 52 upward. The upward displacement of the pressing-side braking member 23 is inhibited when the pressing-side braking member 23 reaches the predetermined upper limit position because the adjusting member 52 engages with the stopper receiving portion 41 (that is, because the stopper receiving portion 41 receives the adjusting member 52). Therefore, the adjusting member 52 has a function as a stopper for inhibiting the upward displacement of the pressing-side braking member 23 at the predetermined upper limit position.

The adjusting member 52 includes, in a part thereof on the pressing member 53 side, an adjusting member inclined portion 52*a* that is inclined with respect to the car guide rail 2. The adjusting member inclined portion 52*a* is inclined with respect to the car guide rail 2 so that the interval between the adjusting member inclined portion 52*a* and the car guide rail 2 is continuously narrowed toward the upward side.

The pressing member 53 includes a pressing member inclined portion 53*a* that is brought into contact with the adjusting member inclined portion 52*a*. The pressing member inclined portion 53*a* is inclined with respect to the car guide rail 2 at the same inclination angle as the adjusting member inclined portion 52*a*.

The pressing member 53 is guided in the horizontal direction with respect to the emergency stop frame 21 between the bottom portion of the car 3 and the upper end portion of the inclined guide portion 31. The pressing member 53 is displaced in a direction to separate from the car guide rail 2 to approach the elastic member receiving portion 55, and is displaced in a direction to approach the car guide rail 2 to separate from the elastic member receiving portion 55. The adjusting elastic member 24 is compressed between the pressing member 53 and the elastic member receiving portion 55. With this, the direction of the elastic restoring force of the adjusting elastic member 24 with respect to the emergency stop frame 21 is set to the horizontal direction that differs from the displacement direction of the adjusting member 52. An engagement bolt 56 that passes through the adjusting elastic member 24 and the elastic member receiving portion 55 is threadably mounted to the pressing member 53. The displacement of the pressing member 53 in the direction to approach the car guide rail 2 is inhibited through the engagement of the engagement bolt 56 with the elastic member receiving portion 55.

When the adjusting member 52 is pressed upward by the adjusting bolt 47, the adjusting member 52 is displaced upward with respect to the emergency stop frame 21 against the elastic restoring force of the adjusting elastic member 24 while the adjusting member inclined portion 52*a* presses the pressing member 53 in the horizontal direction. The pressing member 53 is displaced in the direction to separate from the car guide rail 2 while pressing and compressing the adjusting elastic member 24 in accordance with the upward displacement of the adjusting member 52. With this, the magnitude of the elastic restoring force of the adjusting elastic member 24 increases as the adjusting member 52 is displaced upward with respect to the emergency stop frame 21 (that is, as the adjusting member 52 approaches the adjusting member upper limit position).

In this case, the displacement amount of the pressing member 53 with respect to the displacement amount of the adjusting member 52 decreases as the inclination angle of the adjusting member inclined portion 52*a* and the pressing member inclined portion 53*a* with respect to the car guide rail 2 becomes steeper, and the displacement amount of the pressing member 53 with respect to the displacement amount of the adjusting member 52 increases as the inclination angle of the adjusting member inclined portion 52*a* and the pressing member inclined portion 53*a* with respect to the car guide rail 2 becomes gentler. In the pressing mechanism 51, the inclination angle of the adjusting member inclined portion 52*a* and the pressing member inclined portion 53*a* with respect to the car guide rail 2 is adjusted so that the amount of horizontal displacement of the pressing member 53 is adjusted with respect to the amount of vertical displacement of the adjusting member 52. That is, the relationship between the compressed amount of the adjusting elastic member 24 (magnitude of the elastic restoring force of the adjusting elastic member 24) and the displacement amount of the adjusting member 52 is adjusted through adjustment of the inclination angle of the adjusting member inclined portion 52*a* and the pressing member inclined portion 53*a* with respect to the car guide rail 2. In this embodiment, the amount of horizontal displacement of the pressing member 53 (compressed amount of the adjusting elastic member 24) is smaller than the amount of vertical displacement of the adjusting member 52.

When the emergency stop device 11 carries out the braking operation in the low load applied state illustrated in FIG. 8, while the adjusting member 52 is separated from the stopper receiving portion 41, the elastic restoring force of the adjusting elastic member 24 suppresses the upward displacement of the pressing-side braking member 23 with respect to the emergency stop frame 21. With this, the amount of upward displacement of the pressing-side braking member 23 with respect to the emergency stop frame 21 is reduced, and the magnitude of the gripping force F of the emergency stop device 11 is reduced in accordance with the magnitude of the load W1 applied to the emergency stop device 11.

When the emergency stop device 11 carries out the braking operation in the high load applied state illustrated in FIG. 9, the elastic restoring force of the adjusting elastic member 24 cannot sufficiently suppress the upward displacement of the pressing-side braking member 23. Thus, the adjusting member 52 reaches the stopper receiving portion 41 to reach the predetermined upper limit position of the pressing-side braking member 23. With this, the amount of upward displacement of the pressing-side braking member 23 with respect to the emergency stop frame 21 becomes maximum, and the magnitude of the gripping force F of the emergency stop device 11 takes a maximum value in a range set for the gripping force of the emergency stop device 11. Other configurations and operations are similar to those of the second embodiment.

In such an emergency stop device 11 for an elevator, the pressing member 53 is displaced in the direction to separate from the car guide rail 2 while pressing and compressing the adjusting elastic member 24 in accordance with the upward displacement of the adjusting member 52. Therefore, by adjusting the displacement amount of the pressing member 53 with respect to the displacement amount of the adjusting member 52, the relationship between the magnitude of the elastic restoring force of the adjusting elastic member 24 and the displacement amount of the pressing-side braking member 23 can be adjusted. With this, a plurality of combinations can be applied to the relationship between the magnitude of the elastic restoring force of the adjusting elastic member 24 and the displacement amount of the pressing-side braking member 23, and the range of the required specification for the emergency stop device 11 can be set large. With this, the emergency stop device 11 based on the required specification can be easily realized, and further the cost of the emergency stop device 11 can be reduced.

Further, the adjusting member 52 includes the adjusting member inclined portion 52*a* that is inclined with respect to the car guide rail 2, and the adjusting member 52 is displaced upward with respect to the emergency stop frame 21 while pressing the pressing member 53 by the adjusting member inclined portion 52*a*. Therefore, the relationship between the magnitude of the elastic restoring force of the adjusting elastic member 24 and the displacement amount of the pressing-side braking member 23 can be easily adjusted by only adjusting the inclination angle of the adjusting member inclined portion 52*a* with respect to the car guide rail 2.

Note that, in the above-mentioned embodiment, the adjusting bolt 47 and the retaining nut 48 are provided to the upper end portion of the pressing-side braking member 23, but the adjusting bolt 47 and the retaining nut 48 may be omitted so that the pressing-side braking member 23 directly hits against the adjusting member 52.

Further, in the above-mentioned embodiment, the bottom portion of the car 3 serves as the stopper receiving portion 41, but the stopper receiving portion 41 may be provided to the emergency stop frame 21.

The invention claimed is:

1. An emergency stop device for an elevating body of an elevator, comprising:

a supporting member fixed to the elevating body and comprising an inclined guide portion that is inclined with respect to a guide rail provided for guiding the elevating body;

a receiving-side braking member mounted to the supporting member and elastically pressed onto the guide rail;

a pressing-side braking member for gripping the guide rail together with the receiving-side braking member by being displaced upward with respect to the supporting member while being guided to grip the guide rail by the inclined guide portion;

an adjusting elastic member for generating an elastic restoring force acting against the upward displacement of the pressing-side braking member with respect to the supporting member, wherein a magnitude of a gripping force, which is generated when the guide rail is gripped between the receiving-side braking member and the pressing-side braking member, increases as the pressing-side braking member is displaced upward with respect to the supporting member, and wherein a magnitude of the elastic restoring force of the adjusting elastic member increases as the pressing-side braking member is displaced upward with respect to the supporting member; and a pressing mechanism comprising:

an adjusting member which is relatively movable with respect to the pressing-side braking member and which is upwardly displaced with respect to the supporting member while being pressed by the pressing-side braking member; and a pressing member configured to be displaced with respect to the supporting member in a direction to separate from the guide rail in accordance with the upward displacement of the adjusting member, to thereby press and compress the adjusting elastic member, wherein the adjusting elastic member generates the elastic restoring force by being compressed by the pressing member.

2. The emergency stop device according to claim 1, further comprising a stopper for inhibiting the upward displacement of the pressing-side braking member when the pressing-side braking member reaches a predetermined upper limit position with respect to the supporting member.

* * * * *